US005759073A

United States Patent [19]

Sumino et al.

[11] Patent Number: 5,759,073

[45] Date of Patent: Jun. 2, 1998

[54] DUAL PROPELLER SYSTEM FOR MARINE DRIVE

[75] Inventors: Yoshitsugu Sumino; Ryoji Nakahama, both of Hamamatsu, Japan

[73] Assignee: Sanshin Kogyo Kabushiki Kaisha, Shizuoka, Japan

[21] Appl. No.: 707,523

[22] Filed: Sep. 4, 1996

[30] Foreign Application Priority Data

Sep. 4, 1995 [JP] Japan ..... 7-226651

[51] Int. Cl.[6] ..... B63H 5/10

[52] U.S. Cl. ..... 440/81; 440/66

[58] Field of Search ..... 440/80, 81, 89; 416/90 R, 90 A, 93 R, 93 A, 128, 236 A

[56] References Cited

U.S. PATENT DOCUMENTS

| | | | |
|---|---|---|---|
| 2,099,229 | 11/1937 | Possenheim | 416/236 A |
| 3,012,709 | 12/1961 | Schnell | 416/236 A |
| 3,434,447 | 3/1969 | Christensen et al. . | |
| 4,545,771 | 10/1985 | Iio . | |
| 4,793,773 | 12/1988 | Kinouchi et al. | 416/93 A |
| 4,802,872 | 2/1989 | Stanton | 416/93 A |
| 5,529,520 | 6/1996 | Iwashita et al. . | |

FOREIGN PATENT DOCUMENTS

| | | | |
|---|---|---|---|
| 2319832 | 10/1973 | Germany | 416/93 A |

*Primary Examiner*—Jesus D. Sotelo

*Attorney, Agent, or Firm*—Knobbe, Martens, Olson & Bear, LLP

[57] ABSTRACT

A propulsion system for a marine drive, which includes a pair of counter-rotating propellers, provides improved acceleration from idle or low speeds. Engine exhaust from an engine which powers the marine drive is conveyed to the water about each of the propellers. The exhaust gases aerate the water about each propeller to reduce drag resistance on each propeller. Several embodiments of the propulsion system are disclosed which convey the exhaust gases to both propellers for this purpose.

32 Claims, 7 Drawing Sheets

DUAL PROPELLER SYSTEM FOR MARINE DRIVE

BACKGROUND OF THE INVENTION

1. Field of the Invention

The present invention relates to a marine drive. In particular, the present invention relates to an improves exhaustion system used with a dual counter-rotating propeller system of a marine drive.

2. Description of Related Art

Many marine propulsion systems now employ a counter-rotating propeller device. Front and rear propellers of the system, which are of opposite hand and which rotate in opposite directions about a common drive axis, together produce a forward driving thrust. This dual propeller arrangement provides improved propulsion efficiency and enhances the handling characteristics of the watercraft.

Counter-rotating propeller devices, however, place a large load on the engine associated with the marine propulsion system. The drag of the two propellers significantly reduces the ability of the engine to quickly accelerate the propellers. Propeller blade acceleration consequently suffers. The propellers take longer to accelerate to a desired rotational speed. As a result, the marine propulsion system takes longer to get the associated watercraft up on plane (i.e., planing over the surface of the body of water in which the watercraft is operated).

In order to quicken acceleration, some marine drives discharge at least a portion of exhaust gas discharge upstream of the propulsion system when operating at idle or at low speeds. U.S. Pat. No. 5,529,520, issued to Sanshin Industries, the assignee hereof, discloses an example of this type of marine drive. The exhaust gases discharged in the vicinity of the front propeller aerate the water so as to reduce water resistance on the front propeller. The propellers consequently accelerates more quickly.

SUMMARY OF THE INVENTION

The present invention includes the recognition that acceleration of the propulsion system can be improved by discharging engine exhaust in the vicinity of each of the propellers, rather than at a point upstream of the propulsion system. One aspect of the present invention thus involves a marine drive in which engine exhaust is conveyed to the vicinity of each of the propellers of a dual counter-rotating propulsion system of the marine drive. At idle or at low speeds, the exhaust gases aerate the water around both of the propellers. The propellers consequently accelerate quickly as less drag resistance occurs in the aerated water about both of the propellers.

For this purpose, a marine drive which includes a propulsion device is provided. The propulsion device comprises front and rear propellers which are intended to rotate in opposite directions about a common rotational axis. A lower housing supports the propulsion device. An exhaust system cooperates with the propulsion system to discharges exhaust gases through the lower housing, as well as to a first location in the vicinity of the front propeller and to a second location in the vicinity of the rear propeller. The dual-location exhaustion aerates the water about both the front and rear propellers for improved acceleration.

Another aspect of the present invention involves a marine drive including an internal combustion engine which drives a propulsion device for a watercraft. The propulsion device comprises a first propeller and a second propeller. The propellers are intended to rotate in opposite directions relative to each other with the second propeller being positioned behind the first propeller. Exhaust discharge means is provided for conveying exhaust gases from the engine to a first location near the first propeller and to a second location near the second propeller.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF THE PREFERRED EMBODIMENTS

The present propulsion system 10 provides for quicker acceleration than conventional drives by using engine exhaust to aerate the water about the blades of both of its propellers when accelerating from low speeds. The invention thus has applicability with a variety of types of marine drives, such as, for example, with outboard drives, with inboard/outboard drives, and with inboard drives. In order to illustrate the invention, the present propulsion system is described in connection with an outboard motor; however, this environment of use is merely exemplary.

Before describing the present propulsion system, the general components of a conventional outboard motor 12, as mounted on a transom 14 of a watercraft 16, are first described in order to aid the reader's understanding of the illustrated embodiment. The details of the present propulsion system 10 then follow.

Figure 1:
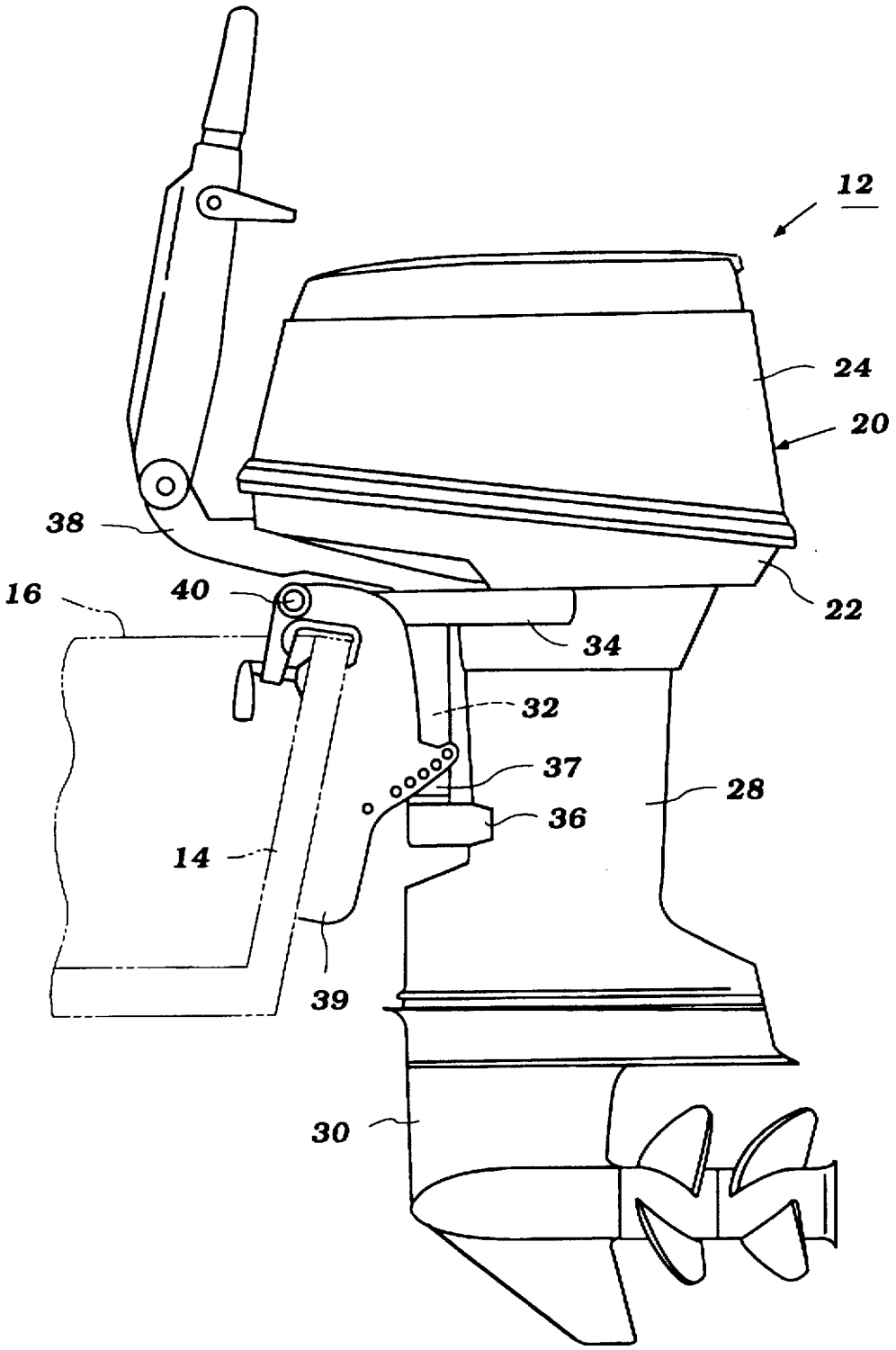
FIG. 1 is a side elevational view of an outboard motor of a type which can incorporate the present propulsion system.

FIG. 1 illustrates a conventional outboard motor 12. The outboard motor 12 has a power head 18 which includes an engine (not shown). A conventional protective cowling 20 surrounds the engine. The cowling 20 desirably includes a lower tray 22 and a top cowling member 24. These components 22, 24 of the protective cowling 20 together define an engine compartment which houses the engine.

The engine is mounted conventionally with its output shaft (i.e., crankshaft) rotating about a generally vertical axis. The crankshaft (not shown) drives a drive shaft 26 (see FIG. 2), as known in the art. The drive shaft 26 depends from the power head 18 of the marine drive 10.

A drive shaft housing 28 extends downward from the lower tray 22 and terminates in a lower unit 30. The drive shaft 26 extends through and is journaled within the drive shaft housing 28.

A steering shaft 32 is affixed to the drive shaft housing 28 by upper and lower brackets 34, 36. The brackets 34, 36 support the steering shaft 32 within a swivel bracket 37 for steering movement. Steering movement occurs about a generally vertical steering axis which extends through a shaft of the steering shaft assembly 32, as known in the art. A steering arm 38 which is connected to an upper end of the steering shaft can extend in a forward direction for manual steering of the marine drive 10, as known in the art.

The steering shaft assembly 32 also is pivotably connected to a clamping bracket 39 by a pin 40. The clamping bracket 34, in turn, is configured to attached to the transom 14 of the watercraft 16. This conventional coupling permits the marine drive 10 to be pivoted relative to the pin 40 to permit adjustment of the trim position of the marine motor 10 and for tilt-up of the marine motor 10.

Although not illustrated, it is understood that a conventional hydraulic tilt and trim cylinder assembly, as well as a conventional hydraulic steering cylinder assembly can be used as well with the present marine drive 10. The construction of the steering and trim mechanism is considered to be conventional and, for that reason, further description is not believed necessary for appreciation and understanding of the present invention.

Figure 2:
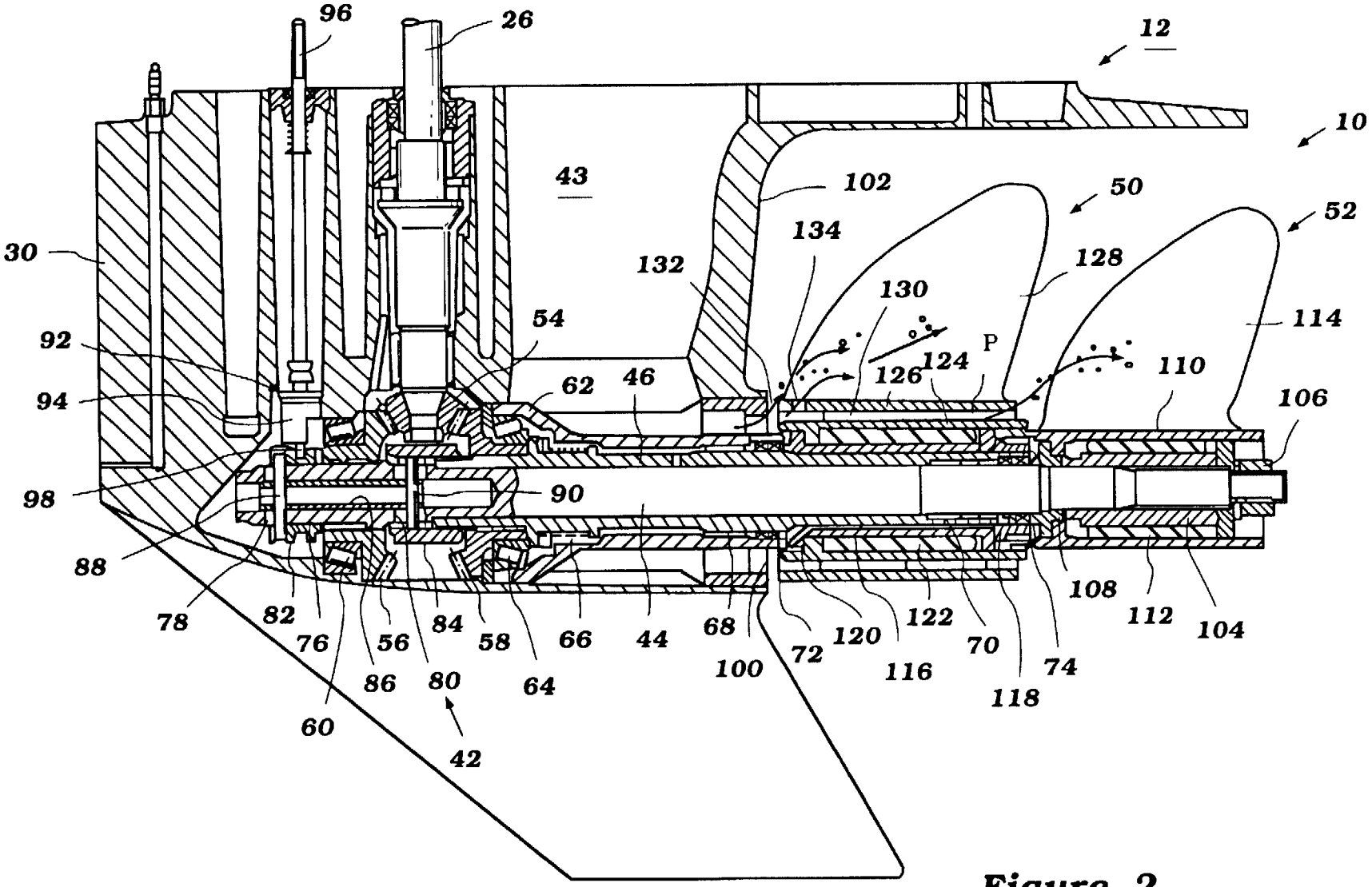
FIG. 2 is a partial-sectional, side view of a lower unit of an outboard motor which includes a propulsion system configured in accordance with a preferred embodiment of the present invention.

FIG. 2 illustrates a preferred embodiment of the propulsion system 10 together with an exemplary transmission 42 and exhaust discharge passage 43 within the lower unit 30. As illustrated in this figure, the drive shaft 26 extends from the drive shaft housing 28 into the lower unit 30 where a transmission 42 selectively couples the drive shaft 26 to an inner propulsion shaft 44 and to an outer propulsion shaft 46. The transmission 42 advantageously is a forward/neutral/reverse-type transmission. In this manner, the drive shaft 26 drives the inner and outer propulsion shafts 44, 46 (which rotate in a first direction and in a second counter direction, respectively) in any of these operational states, as described below in detail.

The propulsion shafts 44, 46 drive the propulsion device 10. As mentioned above, the propulsion device 10 is a counter-rotating propeller device that includes a front propeller 50 designed to spin in one direction and to assert a forward thrust, and a rear propeller 52 designed to spin in the opposite direction and to assert a forward thrust. The counter-rotational propulsion device 10 will be explained in detail below.

The drive shaft 26 carries a drive gear 54 at its lower end, which is disposed within the lower unit 30 and which forms a portion of the transmission 42. The drive gear 54 preferably is a bevel type gear.

The transmission 42 also includes a pair of counter-rotating driven gears 56, 58 that are in mesh engagement with the drive gear 54. The pair of driven gears 56, 58 preferably are positioned on diametrically opposite sides of the drive gear 54, and are suitably journaled within the lower unit 30, as described below. Each driven gear 56, 58 is positioned at about a 90° shaft angle with the drive gear 54. That is, the propulsion shafts 44, 46 and the drive shaft 26, desirably intersect at about a 90° shaft angle; however, it is contemplated that the drive shaft 26 and the propulsion shafts 44, 46 can intersect at almost any angle.

In the illustrated embodiment, the pair of driven gears 56, 58 are a front bevel gear and an opposing rear bevel gear. The front gear 56 includes a hub which is journaled within the lower unit 30 by a front thrust bearing. The front thrust bearing 60 rotatably supports the front gear 56 in mesh engagement with the drive gear 54. The hub has a central bore through which the inner propulsion shaft 44 passes when assembled. The inner propulsion shaft 44 is suitably journaled within the central bore of the front gear hub.

The front gear 56 also includes a series of teeth on an annular front-facing engagement surface, and includes a series of teeth on an annular rear-facing engagement surface. The teeth on each surface positively engage a portion of a clutch of the transmission 42, as described below.

The rear gear 58 also includes a hub which is suitably journaled within a bearing carrier 62 by a rear thrust bearing 64. The rear thrust bearing 64 rotatably supports the rear gear 58 in mesh engagement with the pinion 54.

The hub of the rear gear 58 has a central bore through which the inner propulsion shaft 44 and the outer propulsion shaft 46 pass. The rear gear 58 also includes an annular front engagement surface which carries a series of teeth for positive engagement with a clutch of the transmission 42, as described below.

The inner propulsion shaft 44 and the hollow outer propulsion shaft 46 are disposed within the lower unit 30. The bearing casing 62 rotatably supports the outer propulsion shaft 46. A front needle bearing assembly 66 journals a front end of the outer propulsion shaft 46 within the bearing casing 66. A needle bearing assembly 68 supports the outer propulsion shaft 46 within the bearing casing 62 at an opposite end of the bearing casing 62 from the front bearing assembly 66.

As seen in FIG. 2, the inner propulsion shaft 44, as noted above, extends through front gear hub and the rear gear hub, and is suitably journaled therein. On the rear side of the rear gear 58, the inner shaft 44 extends through the outer shaft 46 and is suitably journaled therein by at least one needle bearing assembly 70 which supports the inner shaft 44 at the rear end of the outer shaft 46.

A first pair of seals 72 (e.g., oil seals) are interposed between the bearing casing 62 and outer propulsion shaft 46 at the rear end of the bearing casing 62. Likewise, a second pair of seals 74 (e.g., oil seals) are interposed between the inner shaft 44 and the outer shaft 46 at the rear end of the outer shaft 46. Lubricant within a lubricant sump flows through the gaps between the bearing casing 62 and the outer shaft 46, and between the outer shaft 46 and the inner shaft 44 to lubricate the bearings 66, 68, 70 that support the inner propulsion shaft 44 and the outer propulsion shaft 46. The seals 72, 74, located at the rear ends of the bearing casing 62 and of the outer shaft 46, substantially prevent lubricant flow beyond these points.

The front end of the inner propulsion shaft 44 includes a longitudinal bore 76. The bore 76 stems from the front end of the inner shaft 44 to a bottom surface which is positioned on the rear side of the axis of the drive shaft 26. A front aperture 78 extends through the inner shaft 44, transverse to the axis of the longitudinal bore, at a position forward of the front bevel gear 56. The inner shaft 44 also includes a rear aperture 80 that extends transverse to the axis of the longitudinal bore 76 and is generally symmetrically positioned between the front bevel gear 56 and the rear bevel gear 58.

Figure 3:
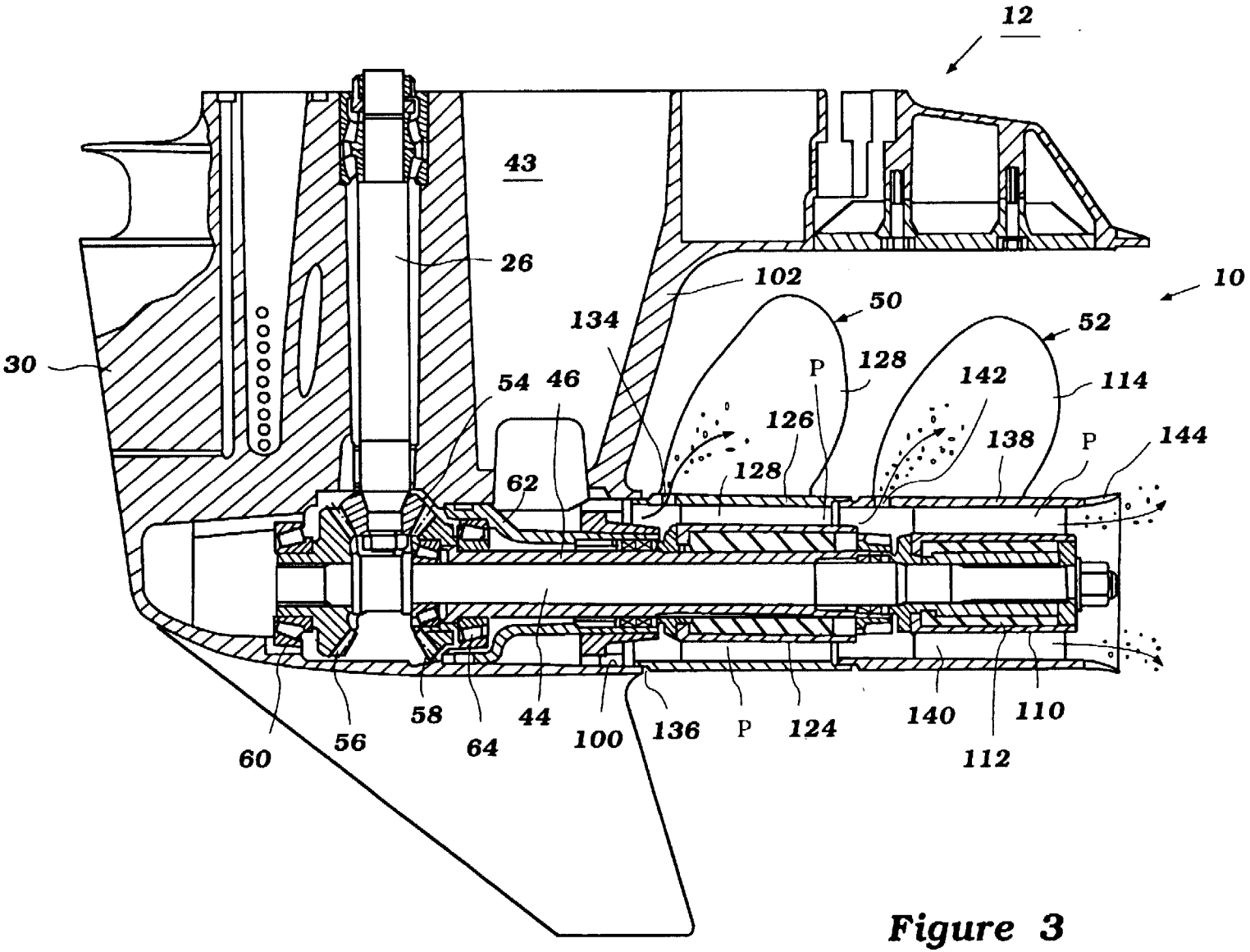
FIG. 3 is a partial-sectional, side view of a lower unit of an outboard motor which includes a propulsion system configured in accordance with another preferred embodiment of the present invention.

As best seen in FIG. 3, the transmission 42 also includes a front dog clutch 82 and a rear dog clutch 84 coupled to a plunger 86. The front dog clutch 82 selectively couples the inner propulsion shaft 44 to the front gear 58. The rear dog clutch 84 selectively couples the outer propulsion shaft 46 to either the front gear 56 or to the rear gear 58. FIG. 2 illustrates the front dog clutch 82 and the rear dog clutch 84 set in a neutral position (i.e., in a position in which the clutches 82, 84 do not engage either the front gear 56 or the rear gear 58).

The plunger 86 has a generally cylindrical rod shape and slides within the longitudinal bore of the inner shaft 76 to actuate the clutches 82, 84. The plunger 76 may be solid; however, it is preferred that the plunger 86 be hollow.

The plunger 86 includes a front hole that is positioned generally transverse to the longitudinal axis of the plunger 86, and a rear hole that is likewise positioned generally transverse to the longitudinal axis of the plunger 86. Each hole desirably is located symmetrically in relation to the corresponding apertures of the inner propulsion shaft 44.

The front dog clutch 82 has a generally cylindrical shape that includes an axial bore. The bore extends through an annular front end and a flat annular rear end of the clutch 82. The bore is sized to receive the inner propulsion shaft 44. Internal splines are formed on the wall of the axial bore. The internal splines mate with external spines formed on the front end of the inner propulsion shaft 44. The resulting spline connection establishes a driving connection between the front clutch 82 to the inner propulsion shaft 44, while permits the clutch 82 to slide along the front end of shaft 44.

The annular rear end surface of the clutch 82 lies generally transverse to the longitudinal axis of the inner propulsion shaft 44. The rear surface of the front dog clutch 82 also is substantially coextensive in the area with the annular front surface of the front gear 56. Teeth extend from the clutch rear surface in the longitudinal direction and desirably corresponds with the teeth on the front surface of the front driven gear 56, both in size (i.e., axial length), in number, and in configuration.

A pair of annular grooves circumscribe the exterior of the front clutch 82. A front groove is sized to receive a retaining spring, as described below. The rear groove is sized to cooperate with an actuator mechanism, which will be described below.

The front clutch 82 also includes a traverse hole that extends through the clutch at the location of the front annular groove. The hole is sized to receive a pin 88 which, when passed through the front aperture 78 of the inner propulsion shaft 44 and through the front hole of the plunger 86, interconnects the plunger 86 and the front clutch 82 with the front clutch 82 positioned on the inner propulsion shaft 44. The pin 88 may be held in place by a press-fit connection between the pin 88 and the front hole, or by a conventional coil spring (not shown) which is contained within the front annular groove about the exterior of the front clutch 82.

The rear clutch 84 is disposed between the two counter-rotating driven gears 56, 58. The rear clutch 84 has a tubular shape that includes an axial bore which extends between an annular front end and an annular rear end. The bore is sized to receive a portion of the outer propulsion shaft 46, which is positioned about the inner propulsion shaft 44.

The annular end surfaces of the rear clutch 84 are substantially coextensive in size with the annular engagement surfaces of the front and rear gears 56, 58, respectively. Teeth extend from the front end of the rear clutch 84 and desirably correspond to the respective teeth of the front gear 56 in size (e.g., axial length), in number, and in configuration. Teeth likewise extend from the rear end surface of the rear clutch 58 and desirably correspond to the respective teeth of the rear gear 58 in size (e.g., axial length), in number, and in configuration.

A spline connection couples the rear clutch 84 to the outer propulsion shaft 46. The clutch 84 thus drives the outer propulsion shaft 46 through the spline connection, yet the clutch 84 can slide along the front end of the shaft 46 between the front and rear gears 56, 58.

The rear clutch 84 also includes a counterbore. The counterbore is sized to receive a coupling pin 90 which extends through the rear aperture 80 of the inner propulsion shaft 44 and through the rear slot of the plunger 86. The pin 90 has a diameter smaller than the length of the aperture 80.

The ends of the pin 90 desirably are captured by an annular bushing which is interposed between a pair of roller bearings. The assembly of the bushings and bearings is captured between a pair of washers and locked within the counterbore of the rear dog clutch 84 by a retainer ring (not shown). The roller bearings journal the assembly of the bushing and the pin 90 within the counterbore to allow the bushing and the pin 90 to rotate in an opposite direction from the rear clutch 84. The pin 90, being captured within the counterbore of the rear clutch 84, however, couples the plunger 86 to the rear clutch 84 in order for the plunger 86 to actuate the rear clutch 84, as described below.

An actuator mechanism 92 moves the plunger 86 of the clutch assembly from a position establishing a forward drive condition, in which the front and rear clutches 82, 84 engage the front and rear gears 56, 58, respectively, through a position of non-engagement (i.e., the neutral position), and to a position establishing a reverse drive condition, in which the rear clutch 84 engages the front gear 56. The actuator mechanism 92 positively reciprocates the plunger 86 between these positions.

The actuator mechanism 92 includes a cam member 94 that connects the front clutch 82 to a rotatable shift rod 96. In the illustrated embodiment, the shift rod 96 is journaled for rotation in the lower unit 30 and extends upwardly to a transmission actuator mechanism (not shown) positioned within the outboard motor cowling 20. The actuator mechanism 92 converts rotational movement of the shift rod 96 into linear movement of the front clutch 82 to move the front clutch 82, as well as the plunger 84 and the rear clutch 84, along the axis of the propulsion shaft 44, 46.

The cam member 94 is affixed to a lower end of the shift rod 96. The cam member 94 includes an eccentrically positioned drive pin 98 which extends downwardly from the cam member 94. The cam member 94 also includes a cylindrical upper portion which is positioned to rotate about the axis of the shift rod 96 and is journaled within the lower unit 30. The drive pin 98 extends into the rear annular groove of the front clutch 82 and is sized to slide within the groove.

The drive pin 98 of the cam member 94 moves both axially and transversely with rotation of the cam member 94 because of the eccentric position of the drive pin 98 relative to the rotational axis of the shift rod 96. The pin 98 transfers the linear or axial component of the eccentric motion of the cam member 94 to the front clutch 82. The transverse component of the cam member's motion, however, is not transferred to the front clutch 82. This motion is lost as the pin 98 slides within the rear groove of the front clutch 82. The actuator mechanism 92 configured accordingly positively moves the front clutch 82 along the axis of the inner propulsion shaft 44 with rotational movement of the cam member 94 operated by the shift rod 96. The coupling between the actuator mechanism 92 and the front clutch 82, however, allows the front clutch 82 to rotate with the inner propulsion shaft 44 relative to the drive pin 98.

The pin 88, which connects the front clutch 82 to the plunger 86, causes the plunger 86 to rotate with the front clutch 82 and the inner propulsion shaft 44. The coupling also conveys the axial movement of the clutch 82 driven by the actuator mechanism 92 to the plunger 86. The plunger 86 consequently moves the rear clutch 84.

As noted above, the bearing carrier 62 supports the propulsion shafts 44, 46 on a side of the transmission 42 opposite of the shift actuator mechanism 92. In the illustrated embodiment, the bearing carrier 62 lies within the lower unit 30, and more specifically within the exhaust discharge conduit 43 of the lower unit 30. The exhaust discharge conduit 43 forms a part of an exhaust system. For this purpose, the exhaust discharge conduit 43 communicates with an expansion chamber (not shown) formed in the drive shaft housing 28 (FIG. 1). The exhaust system communicates with the engine of the outboard motor 12 and conveys exhaust gases to the expansion chamber for silencing, as known in the art. From the expansion chamber, the exhaust gases are discharged through the exhaust discharge conduit 43.

The exhaust conduit 43 in the lower unit 30 extends from an upper end of the lower unit 30 to an exhaust outlet 100 formed on a rear wall 102 of the lower unit 30. The exhaust outlet 100 desirably has a circular shape and generally is concentrically positioned about a common drive axis of the shafts 44, 46.

As understood from FIG. 2, the propeller shafts 44, 46, when coupled to the drive shaft 26 by the transmission 42, drive the propulsion device 10. The propulsion device 10 of FIG. 2 will now be described in detail.

As seen in FIG. 2, the inner shaft 44 extends beyond the rear end of the outer shaft 46. The rear end of the inner shaft 44 carries an engagement sleeve 104 of the rear propeller 52. The engagement sleeve 104 has a spline connection with the rear end of the inner shaft 44. The sleeve 104 is fixed to the inner shaft rear end between a retaining washer secured by a nut 106 threaded on the rear end of the shaft 44 and a rear thrust washer 108 that engages the inner shaft 44 proximate to the rear end of the outer shaft 46.

The inner shaft 44 also carries a rear propeller hub 110. An elastic bushing 112 is interposed between the engagement sleeve 104 and the propeller hub 110 and is compressed therebetween. The bushing 112 is secured to the engagement sleeve 104 by a heat process known in the art. The frictional engagement between the hub 110, the elastic bushing 112, and the engagement sleeve 104 is sufficient to transmit rotational forces from the sleeve 104, driven by the inner propulsion shaft 44, to propeller blades 114 attached to the propeller hub 110.

The outer shaft 46 carries the front propeller 50 in a similar fashion. The rear end portion of the outer shaft 46 carries a second engagement sleeve 116 in driving engagement thereabout by a spline connection. The second engagement sleeve 116 is secured onto the outer shaft 46 between a retaining ring 118 and a front thrust washer 120.

A second annular elastic bushing 122 surrounds the second engagement sleeve 116. The bushing 122 is secured to the sleeve 116 by a heat process known in the art.

An inner propeller hub 124 of the front propeller 50 surrounds the elastic bushing 122, which is held under pressure between the hub 124 and the sleeve 116 in frictional engagement. The frictional engagement between the propeller hub 124 and the bushing 122 is sufficient to transmit a rotational force from the sleeve 116 to propeller hub 124.

The front propeller 50 also includes an outer propeller hub 126 to which at least one propeller blade 128 is integrally formed. A plurality of radial ribs 130 extend between the inner hub 124 and the outer hub 126 to support the outer hub 126 about the inner hub 124 and to form passages P through the propeller 52. At least a portion of the engine exhaust is discharged through these passages P, as described below.

As seen in FIG. 3, the front and rear propellers 50, 52 desirably include a plurality of propeller blades, although a singe blade can be used. In the illustrated embodiment, the propellers each include four blades which are integrally formed with the respective outer hub.

The propulsion system 10 also includes an exhaust conveyer which communicates with the exhaust discharge conduit 43 and discharges exhaust gases at two locations: a first location in the vicinity of the front propeller 50 and a second location in the vicinity of the second propeller 52. For this purpose, in the illustrated embodiment, the exhaust conveyer includes a first exhaust egress located in front of the front propeller 50 and a second exhaust egress located in front of the rear propeller 52.

In the illustrated embodiment, the first exhaust egress includes a gap 132 formed between the rear wall 102 of the lower unit 30 and the front propeller 50. The exhaust discharge conduit 43 communicates with the exhaust outlet opening 100 such that a portion of the exhaust gases flowing though the opening 100 flow through the gap 132 when the propellers 50, 52 are idle or running at low speeds.

The first exhaust egress also can include a plurality of opening 134 positioned behind the gap 132. Each opening 134 desirably lies near the front of one of the propeller blades 128 on a blade-face side of the propeller blade 50.

The second exhaust egress in the illustrated embodiment is formed at the end of the front propeller 50. As seen in FIG. 2, an inner diameter of the front propeller outer hub 126 is larger than an outer diameter of the hub 110 of the rear propeller 52. The exhaust passage P through the front propeller 50 terminates at a rear end of the propeller 50 and discharges exhaust gases in front of the rear propeller blades 114. The exhaust system therefore discharges exhaust gases in the vicinity of the juxtaposed ends of the front and rear propellers 50, 52, between the blades 128, 114 of the propellers 50, 52.

In operation, the exhaust system conveys exhaust gases from the engine to the exhaust discharge conduit 43 in the lower unit 30. At least a portion of the exhaust gases flow through the exhaust outlet 100 into the passages P within the front propeller 50 and discharge between the propeller blades 128, 114. At low propeller speeds, at least a portion of the exhaust gases also flow through the gap 132 and the openings 134 in the vicinity of the front end of the front propeller blades 128. The exhaust gases discharged near each of the propellers 50, 52 aerate the water around the propeller blades 128, 114 of the front and rear propellers 50, 52. As schematically illustrated in FIG. 2, the action of the blades 128, 114 of the propellers 50, 52 drives the exhaust gases outwardly away from the respective hub 126, 110 of the propeller 50, 52. The exhaust gases flow over the blade back of the propeller blades 128, 114 and become entrained in the water stream through the propellers 50, 52.

Aeration or cavitation produced by the entrained exhaust gases within the water decreases the viscosity of the water around the blades 128, 114 to reduce drag resistance on the blades 128, 114. This permits the propellers 50, 52 to accelerate more rapidly.

Less propeller resistance in turn reduces the load applied by the propellers 50, 52 on the engine, and more power is available to drive both propellers 50, 52. The outboard motor 12 consequently accelerates quicker.

Water speed over the propellers 50, 52, as well as exhaust speed through the propellers 50, 52, increase with rising engine and propeller speeds. The exhaust gases consequently tend to flow through the exhaust passages P within the front propeller hub 126, rather than through the gap 132 and the openings 134. The exhaust gases also tend to flow over the rear propeller hub 110. The speed of the exhaust gases, as well as the speed of the water flow over the propellers, carries the gasses through the rear propeller 52 in the vicinity of the bases of the propeller blades 114. As a result, the discharged exhaust gases have less effect on cavitation and causes no significant loss of propulsion efficiency when traveling at high speeds.

The following additional embodiments illustrate further variants of an exhaust conveyer used with a dual, counter-rotating propeller system. As understood from the above description, the exhaust conveyer assists the delivery of exhaust gases to locations near propellers to create some cavitation effect around the blades of the front and rear propellers. Because many of the components of the following marine drives are similar to those described above, the above description of similar components should be understood to apply as well to the components of the following embodiment, unless otherwise stated. For this purpose, like reference numerals have been used to indicate like parts between the embodiments.

With reference to FIG. 3, the first exhaust egress is formed by openings 134 that extend through the outer hub 126 of the front propeller in a transverse direction relative to the rotational axis of the propeller 50. At least one opening 134 lies near the front of one of the propeller blades 128 on the blade-face side of the propeller blade 128.

As seen in FIG. 3, the outer hub 126 of the front propeller 128 includes an annular step 136 formed at its front end. The step 136 permits the front end of the propeller 50 to fit within the exhaust opening 100 with a portion of the rear wall 102 of the lower unit 30 overlapping in the axial direction the front portion of the propeller hub 126. In this position, the exhaust passages P communicate with the exhaust discharge conduit 43 through the outlet opening 100.

In the illustrated embodiment, the rear propeller 52 also includes an outer propeller hub 138 to which at least one propeller blade 114 is integrally formed. A plurality of radial ribs 140 extend between the inner hub 110 and the outer hub 138 to support the outer hub 138 about the inner hub 110 and to form passages P through the propeller 52. At least a portion of the engine exhaust is discharged through these passages P, as described below.

The second exhaust egress includes a plurality of openings 142 that extend through the outer hub 138 of the rear propeller 52 in a transverse direction relative to the rotational axis of the propeller 52. At least one opening 142 lies near the front of one of the propeller blades 114 on the blade-face side of the propeller blade 114.

At idle and low engine and propeller speeds, some exhaust gas flow through the openings 134, 142, which are positioned near the blades 128, 114 of the front and rear propellers 50, 52. The exhaust gases aerate the water around the propellers 50, 52, in the manner described above, to quicken acceleration. At high speeds, however, the speed of the exhaust and the low pressure formed at the rear of the rear propeller 52 tends to cause the exhaust gases to flow through a diffuser ring 144 positioned at the rear end of the rear propeller 52.

Figure 4:
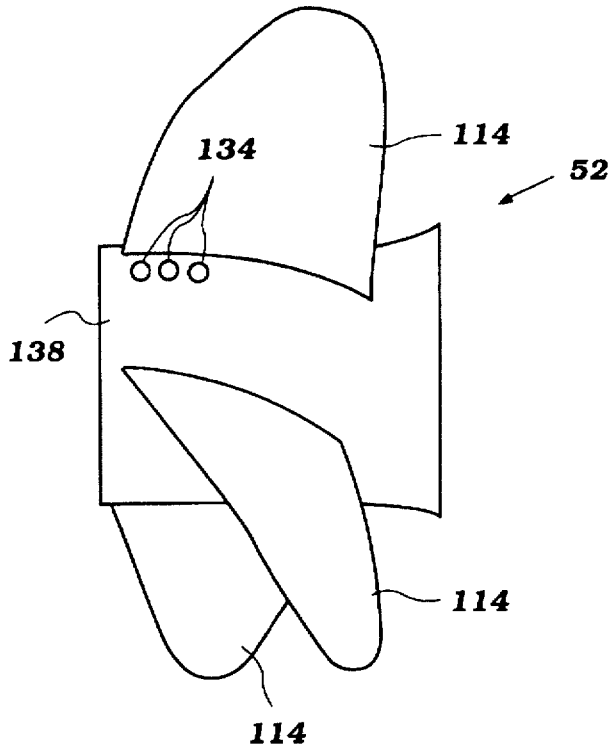
FIG. 4 is a side elevational view of another embodiment of a propeller which can be used with the propulsion system of FIG. 3.
Figure 5:
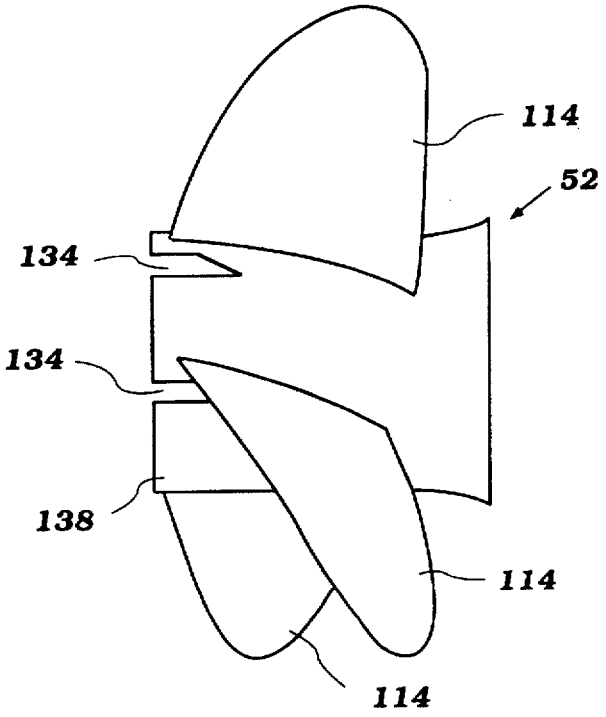
FIG. 5 is a side elevational view of an additional embodiment of a propeller which can be used with the propulsion system of FIG. 3.

FIGS. 4 and 5 illustrate variations of the propeller which can be used in the propulsion system 10 described above in connection with FIG. 3. Although these figures illustrate the propeller as configured as the rear propeller 52, it is understood that the exhaust egress described in connection with the propeller can be used equally well with the front propeller 52 of the propulsion system 10.

The propeller 52 of FIG. 4 includes a plurality of rows of openings 142. Each row of openings 134 lie near the front of one of the propeller blades 114 and on the blade-face side of the propeller blade 114.

FIG. 5 illustrates the exhaust egress openings 142 of the propeller 52 as slots.

The slots 142 extend into the outer hub 138 of the rear propeller 52 from the propeller's front end. Each slot 142 projects to a point behind the front of a corresponding propeller blade 114 and lies to the side of the blade-face of the propeller blade 114.

Figure 6:
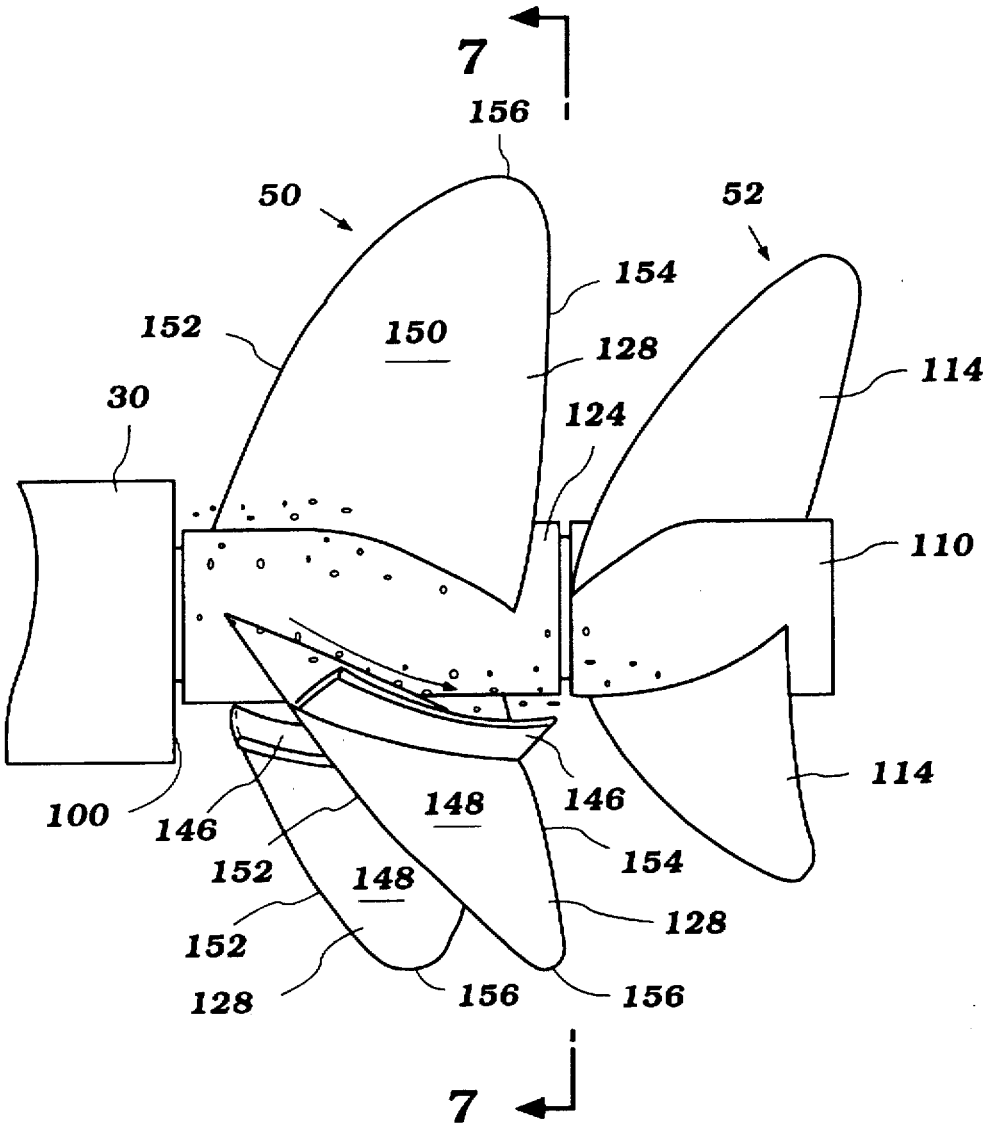
FIG. 6 is a side elevational view of a propulsion system configured in accordance with an additional preferred embodiment of the present invention.

FIG. 6 illustrates a propulsion system 10 configured in accordance with another preferred embodiment of the present invention. In this embodiment, the propeller blades 128, 114 of the front and rear propellers 50, 52 are directly mounted to the corresponding inner hub 124, 110. The propellers 50, 52 thus do not include exhaust passages P through their hubs.

Engine exhaust is discharged through the outlet opening 100 on the rear wall 102 of the lower unit 30 in front of the front propeller 50. The outboard drive includes an exhaust conveyer which conveys at least a portion of the engine exhaust toward the rear propeller 52, while permitting the remaining portion of the engine exhaust to flow through the blades 128 of the front propeller 50.

Figure 8:
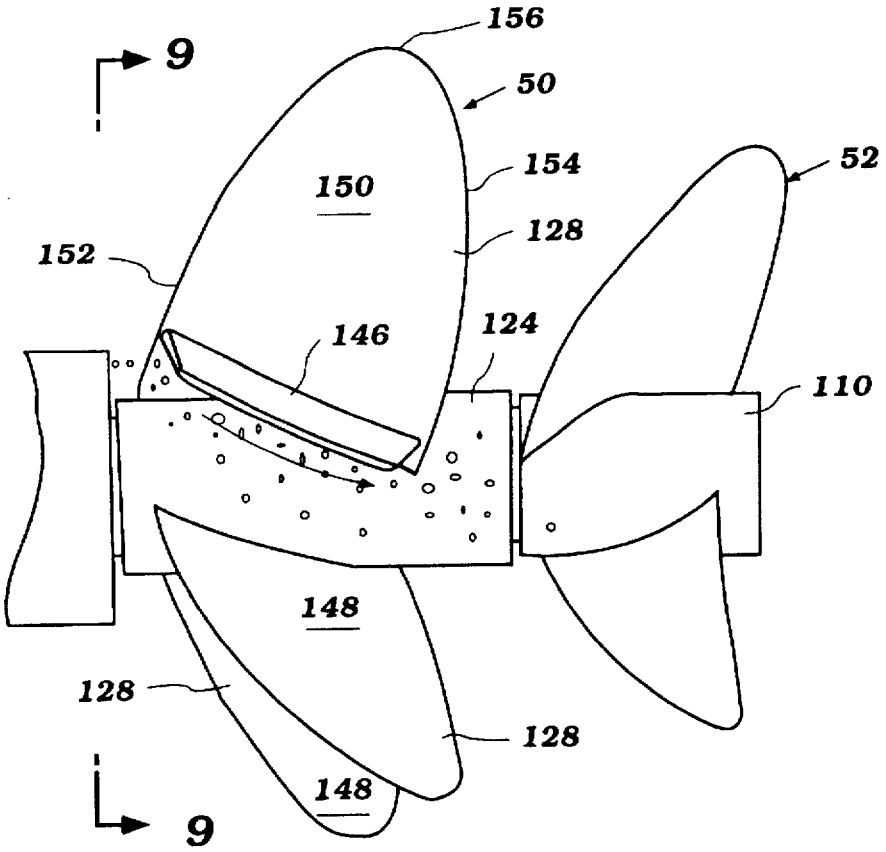
FIG. 8 is a side elevational view of a propulsion system configured in accordance with another preferred embodiment of the present invention.
Figure 9:
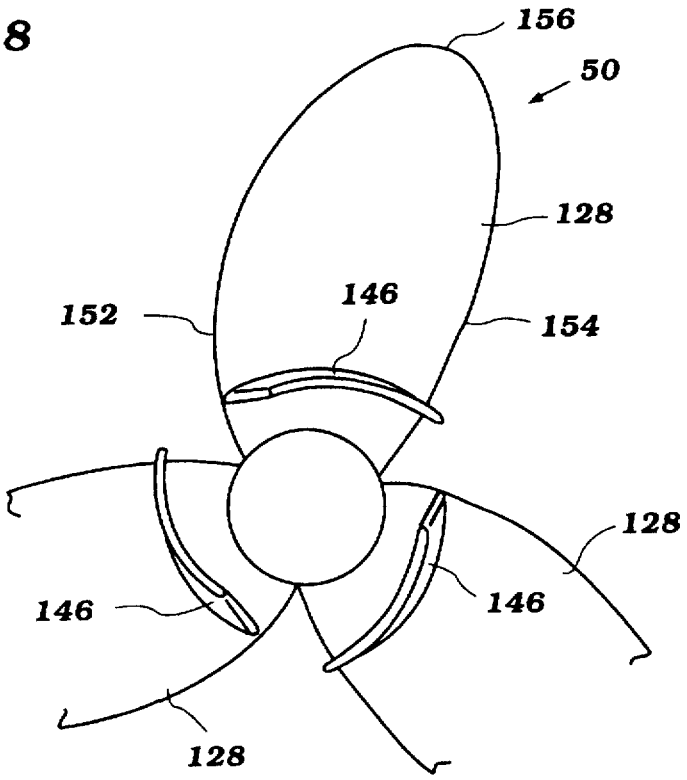
FIG. 9 is a front view of a front propeller of the propulsion system of FIG. 8 as viewed in the direction of line 9—9, with the associated propulsion shafts and the internal structure of the propeller's hub omitted for simplicity.

In the illustrated embodiment, the exhaust conveyer includes a plurality of ribs 146. Each rib 146 is attached to a surface of the propeller and projects from the surface in a direction generally normal to the surface. In the illustrated embodiment, the ribs 146 project from the blade-faces 148 of the propeller blades 128 of the front propeller; however, as seen in FIGS. 8 and 9, the ribs can project from the blade-backs 150 of the front propeller blades.

Figure 7:
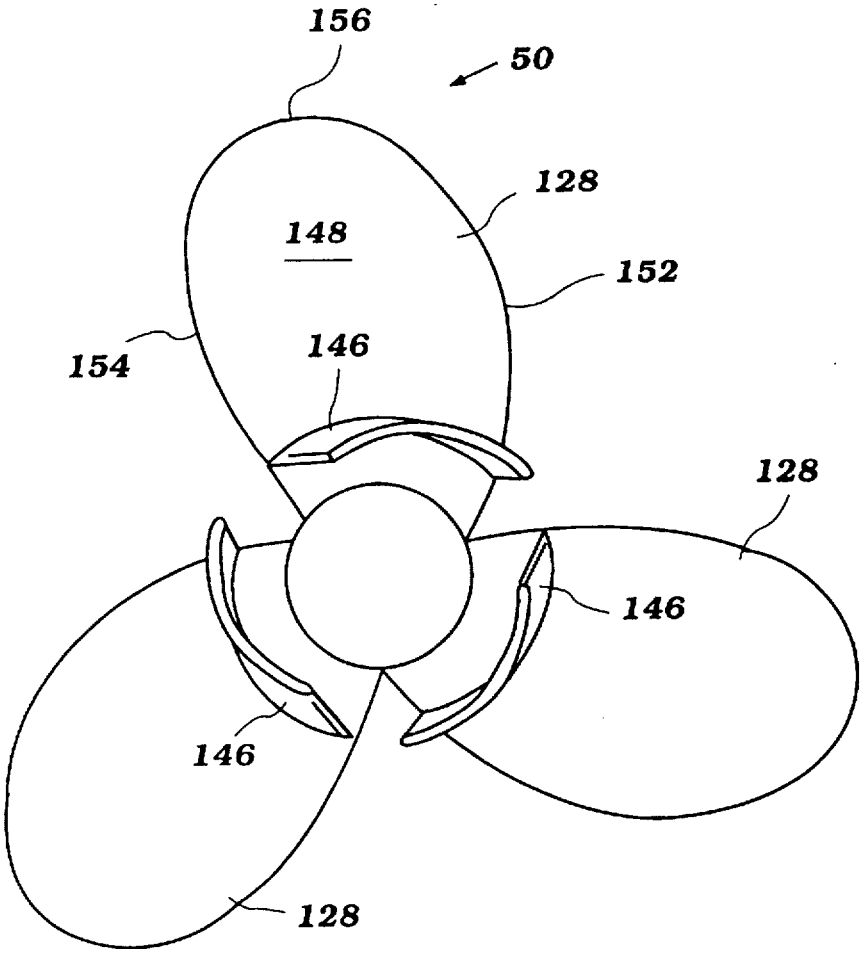
FIG. 7 is a rear view of a front propeller of the propulsion system of FIG. 6 as viewed in the direction of line 7—7, with the associated propulsion shafts and the internal structure of the propeller's hub omitted for simplicity.

As seen in FIGS. 6 and 7, each rib 146 desirably extends from a leading edge 152 of the propeller blade 128 to a trailing edge 154 of the propeller blade 128. The ribs also are positioned closer to the base of the propeller blades 128 (i.e., the point wherein the blade 128 attaches to the propeller hub 124) than to a blade tip 156 of the propeller blade 128.

In operation, engine exhaust is discharge through the outlet opening 100 in front of the front propeller 50. At low speeds, the action of the blades 128 of the front propeller 50 drives a portion of the exhaust gases outwardly away from the propeller hub 126. The exhaust gases flow over the blade backs 150 of the propeller blades 128, and become entrained in the water stream through the propeller 50.

The ribs 146 of the blade-faces 148 of the front propeller trap a portion of the exhaust gases exiting the outlet opening 100 and direct these gases toward the rear propeller 52. In this manner, exhaust gases, which are discharged in front of the front propeller 50, are conveyed to the rear propeller 52 so as to aerate the water about the rear propeller 52.

Water and exhaust speeds over the propellers 50, 52 increase with rising engine and propeller speeds. The exhaust gases consequently tend to flow over the hubs 124, 110 of the propellers 50, 52 and have less effect on cavitation. The speed of the exhaust gases, as well as the speed of the water flow over the propellers 50, 52, carries the gasses through the propellers 50, 52 in the vicinity of the bases of the propeller blades 128, 114. As a result, the discharged exhaust gases have less effect on cavitation and causes no significant loss of propulsion efficiency when traveling at high speeds.

As common to each of the embodiments described above, the exhaust system cooperates with the propulsion system to convey engine exhaust two separate locations: a first location positioned near the front propeller; and a second location positioned near the second propeller. In some of the embodiments, the exhaust gases are discharged at these locations. In other embodiments, the exhaust gases are conveyed from the first location to the second location. In either case, the effect of aerating the water around both the front and rear propellers meaningfully improves acceleration of the marine drive.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A marine drive for a watercraft comprising a propulsion device including a front propeller and a rear propeller intended to rotate in opposite directions about a common rotational axis, a lower housing which supports the propulsion device, and an exhaust system which cooperates with the propulsion system to discharge exhaust gases through the lower housing and to a first location in the vicinity of the front propeller and to a second location in the vicinity of the rear propeller, the front propeller including a hub and at least one propeller blade attached to the hubs the hub having an internal exhaust passage and an exhaust egress located near the front end of the propeller blade at the first location the exhaust egress including at least one transverse opening extending through the front propeller hub and communicating with the exhaust passage of the front propeller hub.

2. A marine drive as in claim 1, wherein the exhaust egress additionally comprises a gap formed between the hub of the front propeller and the lower housing.

3. A marine drive as in claim 1, wherein the front propeller includes a plurality of propeller blades and at least one transverse opening is positioned near a base of each propeller blade.

4. A marine drive as in claim 3, wherein the transverse opening is a hole.

5. A marine drive as in claim 4, wherein the exhaust egress comprises at least an additional hole, and the holes are aligned.

6. A marine drive as in claim 3, wherein the opening is a slot which extends into the hub from a front end of the front propeller.

7. A marine drive as in claim 1, wherein the rear propeller includes at least one propeller blade attached to a rear propeller hub, and the rear propeller hub includes a second exhaust egress located near the front of the rear propeller blade at the second location.

8. A marine drive as in claim 7, wherein the second egress is located between the front propeller blade and the rear propeller blade.

9. A marine drive as in claim 8, wherein the second egress is formed at the end of the exhaust passage through the front propeller.

10. A marine drive as in claim 2, wherein the rear propeller includes an exhaust passage which is formed through the rear propeller hub and which communicates with the exhaust passage through the hub of the front propeller, and the second egress comprises a transverse opening extending through the hub of the rear propeller.

11. A marine drive as in claim 10, wherein the rear propeller includes a plurality of propeller blades and at least one transverse opening is positioned near a base of each propeller blade.

12. A marine drive as in claim 11, wherein the transverse opening is a hole.

13. A marine drive as in claim 12, wherein the exhaust egress comprises at least one additional hole, and the holes are aligned along a line that extends to the rear of the rear propeller.

14. A marine drive as in claim 11, wherein the transverse opening is a slot which extends into the propeller hub from a front end of the rear propeller.

15. A marine drive for a watercraft comprising a propulsion device including a front propeller and a rear propeller intended to rotate about a common rotational axis, the front propeller including at least one propeller blade, a lower housing which supports the propulsion device, and an exhaust system which cooperates with the propulsion system to discharges exhaust gases through the lower housing and to a first location in the vicinity of the front propeller and to a second location in the vicinity of the rear propeller, said propulsion system including an exhaust conveyer including a rib that projects from a blade surface of the front propeller blade and extends in a direction from a leading edge of the propeller blade to a trailing edge of the propeller blade, said rib being configured to guide exhaust gases to at least the second location near the rear propeller.

16. A marine drive as in claim 15, wherein the rib extends from the leading edge to the trailing edge of the propeller blade.

17. A marine drive as in claim 15, wherein the front propeller includes a plurality of propeller blades, and each blade includes a rib projecting from the blade.

18. A marine drive as in claim 15, wherein the rib extends from a blade face of the propeller blade.

19. A marine drive as in claim 15, wherein the rib extends from the blade back.

20. A marine drive as in claim 15, wherein the rib is located closer to the base of the propeller blade than to tip of the propeller blade.

21. A marine drive comprising an internal combustion engine which drives a propulsion device for a watercraft, the propulsion device including a first propeller and a second propeller which are intended to rotate in opposite directions relative to each other with the second propeller being positioned behind the first propeller, and exhaust discharge means for conveying exhaust gases from the engine to a first location near the first propeller and to a second location near the second propeller to aerate the water of the body of water in which the marine drive is operated about the first and second propellers at least when both propellers are running at low speed to reduce drag resistance on the propellers.

22. The marine drive of claim 21, wherein each of the first and second propellers includes a plurality of propeller blades.

23. The marine drive of claim 22, wherein the first location is located in the vicinity of a leading edge of at least one of the blades of the first propeller, and the second location is located in the vicinity of a leading edge of at least one of the blades of the second propeller.

24. The marine drive of claim 23, wherein the first and second propellers are arranged to rotate about a common axis.

25. The marine drive of claim 23, wherein the first location lies in front of at least one blade of the first propeller, and the second location lies in front of at least one blade of the second propeller.

26. The marine drive of claim 23 additionally comprising a lower unit which supports the propulsion system, the lower unit includes an exhaust passage which communicates with the exhaust discharge means.

27. The marine of claim 26, wherein the lower unit houses a transmission coupled to the propulsion system, the transmission being arranged to lie forward at least a portion the exhaust passage of the lower unit.

28. A method of reducing drag on a propulsion device comprising front and rear propellers rotating about a common rotational axis, said method involving the steps of:

rotating the front propeller at a low revolutional speed to produce a forward thrust;

rotating the rear propeller at a low revolutional speed to produce a forward thrust;

discharging a sufficient volume of exhaust gases in the vicinity of the front propeller to aerate the water about the front propeller; and discharging a sufficient volume of exhaust gases in the vicinity of the rear propeller to aerate the water about the rear propeller.

29. A method as in claim 28, wherein the front and rear propellers are rotated in opposite directions.

30. A method as in claim 28, wherein discharging exhaust gases involve discharging exhaust gases through openings in hubs of the propellers.

31. A method as in claim 28, additionally comprising conveying exhaust gases from a point of discharge near the front propeller to a point of discharge near the rear propeller.

32. A method as in claim 31, wherein conveying involves channeling exhaust gases between a hub of the front propeller and at least one rib formed on at least one blade of the front propeller.

* * * * *

UNITED STATES PATENT AND TRADEMARK OFFICE

CERTIFICATE OF CORRECTION

PATENT NO. : 5,759,073

DATED : June 2, 1998

INVENTOR(S) : Yoshitsugu Sumino

It is certified that error appears in the above-identified patent and that said Letters Patent is hereby corrected as shown below:

Claim 1, column 11, line 36, "the hubs the" should be --the hub, the--.

Signed and Sealed this

Sixteenth Day of February, 1999

*Attest:*

*Attesting Officer*

*Acting Commissioner of Patents and Trademarks*